US011710388B1

(12) United States Patent
Lum

(10) Patent No.: US 11,710,388 B1
(45) Date of Patent: Jul. 25, 2023

(54) LED STATUS INDICATING UNIT FOR AN ELECTRICAL APPLIANCE

(71) Applicant: Prime Dragon Limited, Kowloon (HK)

(72) Inventor: Wai Chee Lum, Kowloon (HK)

( * ) Notice: Subject to any disclaimer, the term of this patent is extended or adjusted under 35 U.S.C. 154(b) by 0 days.

(21) Appl. No.: 17/580,611

(22) Filed: Jan. 20, 2022

(51) Int. Cl.
*G08B 5/38* (2006.01)
*F21V 23/04* (2006.01)
*G08B 21/02* (2006.01)

(52) U.S. Cl.
CPC ..... *G08B 5/38* (2013.01); *F21V 23/0464* (2013.01); *G08B 21/0208* (2013.01)

(58) Field of Classification Search
CPC .... G08B 5/38; G08B 21/0208; F21V 23/0464
See application file for complete search history.

(56) References Cited

U.S. PATENT DOCUMENTS 6,593,851 B1 * 7/2003 Bornstein ..... G08B 21/0227 340/568.1
10,987,484 B1 * 4/2021 Konda ..... G08B 21/0211
11,244,547 B1 * 2/2022 Flint ..... G08B 13/19602
2015/0100167 A1 * 4/2015 Sloo ..... G08B 29/04 700/278
2015/0109441 A1 * 4/2015 Fujioka ..... H04N 5/33 348/143
2019/0157894 A1 * 5/2019 Shalaby ..... G06F 1/206
2019/0200872 A1 * 7/2019 Matsuoka ..... A61B 5/0013

* cited by examiner

*Primary Examiner* — Bryon T Gyllstrom

(57) ABSTRACT

An improved LED status indicating unit for an electrical appliance including at least one LED status indicator configured to indicate an operating status of the electrical appliance; at least one sensor; a storage unit configured to store one or more predefined conditions, each of which being associated with a command for controlling one or more lighting parameters of at least one LED status indicator; and a processing unit configured to determine, for each of the one or more signals produced by each of the at least one sensor, whether the signal satisfies any of the one or more predefined conditions; and if the signal satisfies any of the one or more predefined conditions, control the one or more lighting parameters of the at least one LED status indicator which is electrically connected with the processing unit according to the command associated with the predefined condition satisfied.

9 Claims, 7 Drawing Sheets

LED STATUS INDICATING UNIT FOR AN ELECTRICAL APPLIANCE

BACKGROUND OF THE INVENTION

The present invention relates to an LED status indicating unit and more specifically relates to an improved LED status indicating unit for an electrical appliance.

Baby monitors and other electronic nursery devices usually come with LEDs for indicating the operation status, e.g. charging, operating, Bluetooth pairing, etc. However, such LEDs usually do not have automatic dimming nor goes off feature, thus causing distraction to baby or even adults at night. Some baby monitors in the marketplace might allow users to switch on/off the LEDs via mobile APP, but it is inconvenient to users who might not be able to find the feature in the APP.

Besides, in most claimed baby monitors with parent units, they use home cameras and marketed as baby monitor cameras. Such home cameras use IR LEDs with wavelength of 850 nm which is still visible to human eyes and thus distracting babies. Most experts in baby monitors use IR LEDs with wavelength of 940 nm for night vision. The illumination range of IR LEDs with wavelength of 940 nm is 30-40% shorter, compared to 850 nm wavelength, but they are invisible to human eyes with lens covering them.

BRIEF SUMMARY OF THE INVENTION

In view of the aforesaid disadvantages now present in the prior art, it is an object of the present invention to provide an improved LED status indicating unit for an electrical appliance which can automatically dim down or goes off to reduce or stop light disturbance when ambient light level is low (such as at night). The LED status indicating unit is further configured to show caregivers if the room temperature is too high or too low, thereby reducing risk of SIDS and SMSL for babies. The LED status indicating unit is further configured to light up when significant object movement or sound detected to show caregivers the operation state and location of device when attention from the device is needed.

To attain this, the present invention provides an improved LED status indicating unit for an electrical appliance which comprises at least one LED status indicator configured to indicate an operating status of the electrical appliance; at least one sensor each configured to produce one or more signals based on one or more sensor inputs; a storage unit configured to store one or more predefined conditions, each of which being associated with a command for controlling one or more lighting parameters of at least one LED status indicator; and a processing unit electrically connected with the at least one LED status indicator configured to indicate an operating status of the electrical appliance, and provided in operative communication with the at least one sensor and the storage unit, and configured to determine, for each of the one or more signals produced by each of the at least one sensor, whether the signal satisfies any of the one or more predefined conditions; and if the signal satisfies any of the one or more predefined conditions, control the one or more lighting parameters of the at least one LED status indicator which is electrically connected with the processing unit according to the command associated with the predefined condition satisfied.

The at least one sensor may comprise one or more of the following: a light sensor configured to detect one or more ambient light levels as one or more light sensor inputs and produce one or more light sensor signals based on the one or more light sensor inputs, an antenna configured to wirelessly receive one or more control signals input by a user in a mobile application, a parent unit or other device as one or more antenna inputs and produce one or more antenna signals based on the one or more antenna inputs, a temperature sensor configured to detect one or more ambient temperatures as one or more temperature sensor inputs and produce one or more temperature sensor signals based on the one or more temperature sensor inputs, a video sensor or motion sensor configured to detect one or more object movements as one or more video sensor inputs and produce one or more video sensor signals based on the one or more video sensor inputs, a microphone configured to detect one or more sounds as one or more microphone inputs and produce one or more microphone signals based on the one or more microphone inputs.

The one or more lighting parameters may comprise one or more of the following: brightness level, color, flashing pattern, duration, glowing pattern.

The improved LED status indicating unit may further comprise a control signal broadcast module provided in operative communication with the processing unit for broadcasting the command associated with the predefined condition satisfied.

The present invention also provides a baby monitor comprising the improved LED status indicating unit as mentioned above. The baby monitor may further comprise at least one 940 nm IR LED, at least one 850 nm IR LED, and a night mode IR LED selector which is electrically connected to the at least one 940 nm IR LED and the at least one 850 nm IR LED and is configured to switch on the at least one 940 nm IR LED and switch off the at least one 850 nm IR LED, or alternatively switch on both the at least one 940 nm IR LED and the at least one 850 nm IR LED, based on predetermined condition. The predetermined condition may, for example, be upon receipt of a command input by a user interface element on the baby monitor. Also, the predetermined condition may be the instruction given by the baby monitor processing unit to realize a feature. For example, when the baby monitor is not able to identify the location of a baby in a crib in night time, the baby monitoring processing unit will switch on both the at least one 940 nm IR LED and the at least one 850 nm IR LED temporarily in order to increase the visible range. Once the location of the baby is confirmed, the baby monitor processing unit will switch off the at least one 850 nm IR LED so that no IR is visible to users.

The baby monitor may further comprise a nightlight which is electrically connected to the improved LED status indicating unit; the at least one sensor of the improved LED status indicating unit is a light sensor configured to detect one or more ambient light level as one or more light sensor input and produce one or more light sensor signals based on the one or more light sensor input, and the processing unit of the improved LED status indicating unit is configured to control brightness level of the nightlight based on the one or more light sensor signals produced by the light sensor of the improved LED status indicating unit.

The present invention further provides a baby monitoring system comprising a first unit being one of a monitoring unit or a parent unit, and a second unit being another one of the monitoring unit or the parent unit, wherein the first unit comprises the improved LED status indicating unit as in Claim 1, and the improved LED status indicating unit comprises a control signal broadcast module provided in operative communication with the processing unit for broadcasting the command associated with the predefined condition satisfied; the second unit comprises at least one second unit LED status indicator, a control signal receiver which is configured to receive the command broadcasted by the control signal broadcast module of the first unit, and a second unit control module which is electrically connected between the at least one second unit LED status indicator and the control signal receiver and is configured to control one or more lighting parameters of the at least one second unit LED status indicator according to the received command. The at least one sensor of the improved LED status indicating unit may comprise one or more of the following: a light sensor for detecting ambient light level, an antenna for wirelessly receiving one or more control signals input by a user in a mobile application or other devices, a temperature sensor for sensing ambient temperature, a video sensor or motion sensor for sensing object movement, a microphone for sensing sound. The one or more lighting parameters of the improved LED status indicating unit may comprise one or more of the following: brightness level, color, flashing pattern, duration, glowing pattern. The first unit may further comprise a nightlight which is electrically connected to the improved LED status indicating unit; the at least one sensor of the improved LED status indicating unit is a light sensor configured to detect one or more ambient light level as one or more light sensor input and produce one or more light sensor signals based on the one or more light sensor input, and the processing unit of the improved LED status indicating unit is configured to control brightness level of the nightlight based on the one or more light sensor signals produced by the light sensor of the improved LED status indicating unit; the second unit further comprises a second unit nightlight which is electrically connected to the second unit control module; the processing unit of the improved LED status indicating unit of the first unit is further configured to send a control signal to the control signal receiver of the second unit and the second unit control module is configured to control brightness level of the second unit nightlight based on the one or more light sensor signals produced by the light sensor of the improved LED status indicating unit of the first unit.

DETAILED DESCRIPTION OF THE INVENTION

Figure 1:
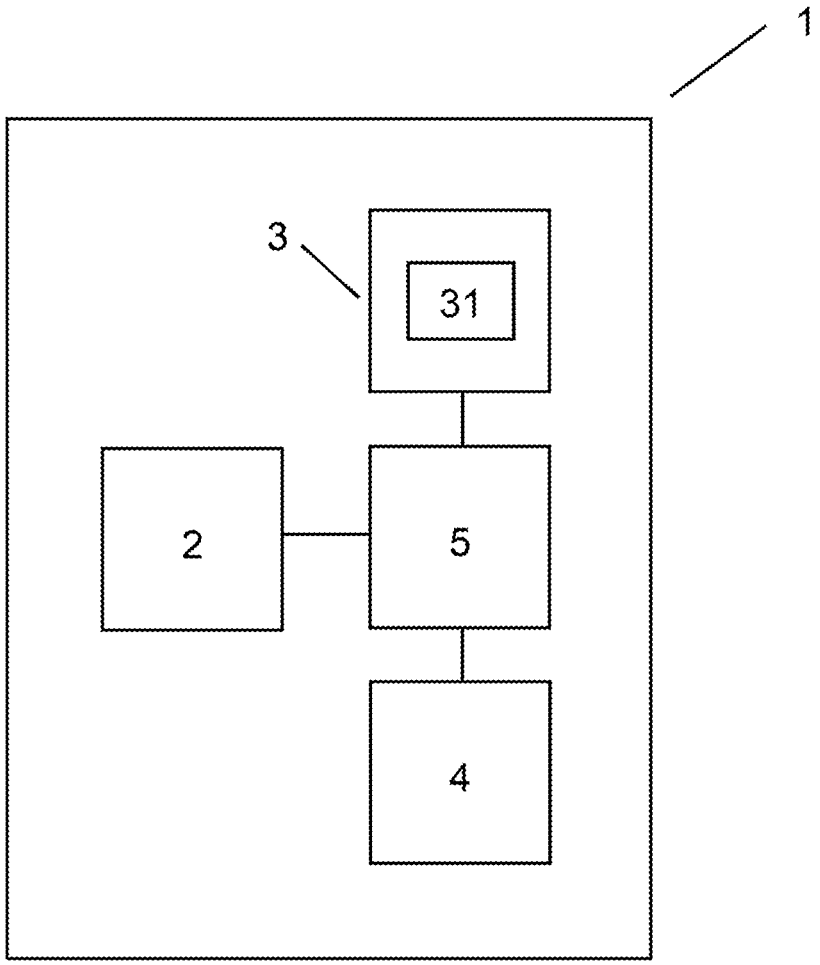
FIG. 1 is a schematic diagram illustrating the first embodiment of the present invention.

As illustrated in FIG. 1, a first embodiment of the improved LED status indicating unit 1 for an electrical appliance (such as a baby monitor) comprises an LED status indicator 2 configured to indicate an operating status of the electrical appliance, a sensor 3 configured to produce one or more signals based on one or more sensor inputs, a storage unit 4 and a processing unit 5. In this embodiment, the sensor 3 is a light sensor 31 configured to detect one or more ambient light levels as one or more light sensor inputs and produce one or more light sensor signals based on the one or more light sensor inputs. The storage unit 4 is configured to store one or more predefined conditions, each of which is associated with a command for controlling the brightness level of at least one LED status indicator. In other embodiments, apart from brightness level, the command may also control other lighting parameters such as flashing pattern, color, duration and so forth of at least one LED status indicator. The processing unit 5 is electrically connected with the LED status indicator 2 and provided in operative communication with the sensor 3 and the storage unit 4, and is configured to determine, for each of the one or more signals produced by the sensor 3, whether the signal satisfies any of the one or more predefined conditions; and if the signal satisfies any one of the one or more predefined conditions, control the brightness level of the LED status indicator 2 according to the command associated with the predefined condition satisfied. As an example, one of the predefined conditions of the storage unit 4 is that the light sensor signal is lower than a threshold value (which means the ambient light level is very low, such as at night time), and the command associated with the aforementioned condition is to lower the brightness level of an LED status indicator to a predefined level (which is very low as not to cause light disturbance to users nearby). In operation, if the LED status indicator 2 is lighted up to indicate an operating status of the electrical appliance (for example, to indicate that the electrical appliance is powered on), and the sensor 3 detects a low ambient light level (such as at night time) so that the light sensor signal satisfies the predefined condition that is associated with the command to lower the brightness level of an LED status indicator, the processing unit 5 then lower the brightness level of the LED status indicator 2 to the predetermined level which is very low as not to cause light disturbance to users nearby; if the sensor 3 detects a high ambient light level (such as at day time) so that the light sensor signal no longer satisfies any of the predefined conditions in the storage unit 4, the processing unit 5 then no longer controls the brightness level of the LED status indicator 2 and the LED status indicator 2 operates to indicate the operating status of the electrical appliance according to predefined setting of the electrical appliance.

Figure 2:
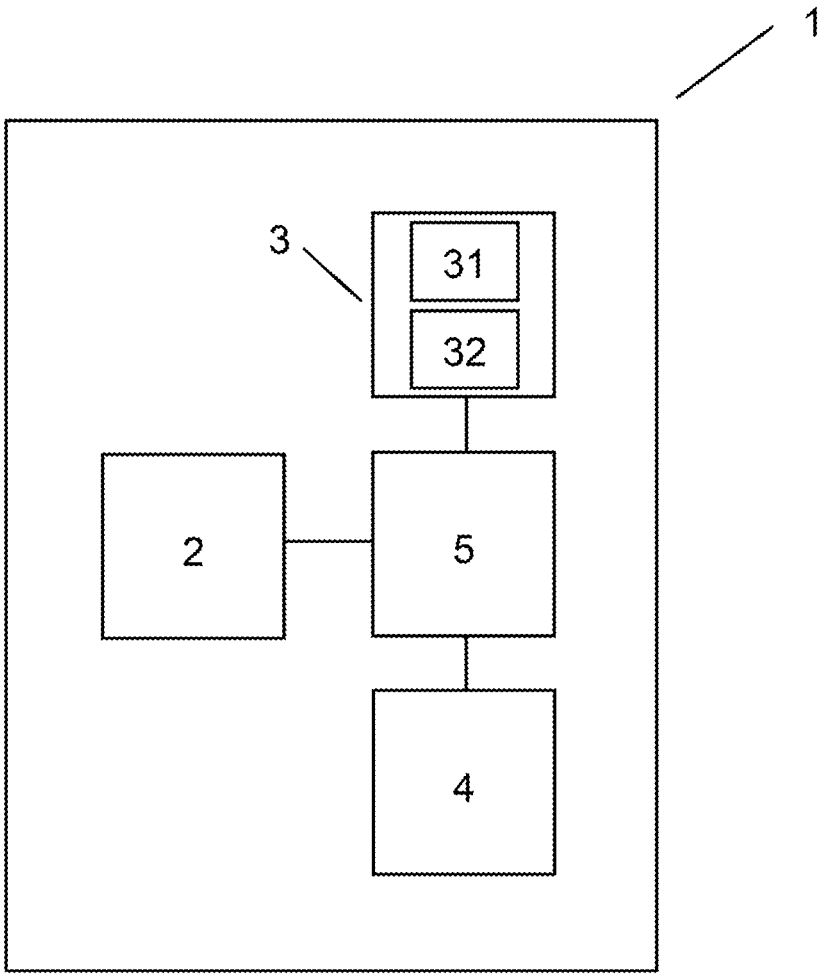
FIG. 2 is a schematic diagram illustrating the second embodiment of the present invention.

FIG. 2 illustrates a second embodiment of the improved LED status indicating unit 1 for an electrical appliance. The second embodiment is substantially the same as the first embodiment except for the following: In the second embodiment, the sensor 3 further comprises an antenna 32 configured to wirelessly receive one or more control signals input by a user in a mobile application, a parent unit or other device as one or more antenna inputs and produce one or more antenna signals based on the one or more antenna inputs. As an example, one of the predetermined conditions of the storage unit 4 is that the antenna signal is a control signal for lowering the brightness level of an LED status indicator to a predefined level (which is very low as not to cause light disturbance to users nearby), and the command associated with the aforementioned condition is to lower the brightness level of an LED status indicator to a predefined level (which is very low as not to cause light disturbance to users nearby).

Figure 3:
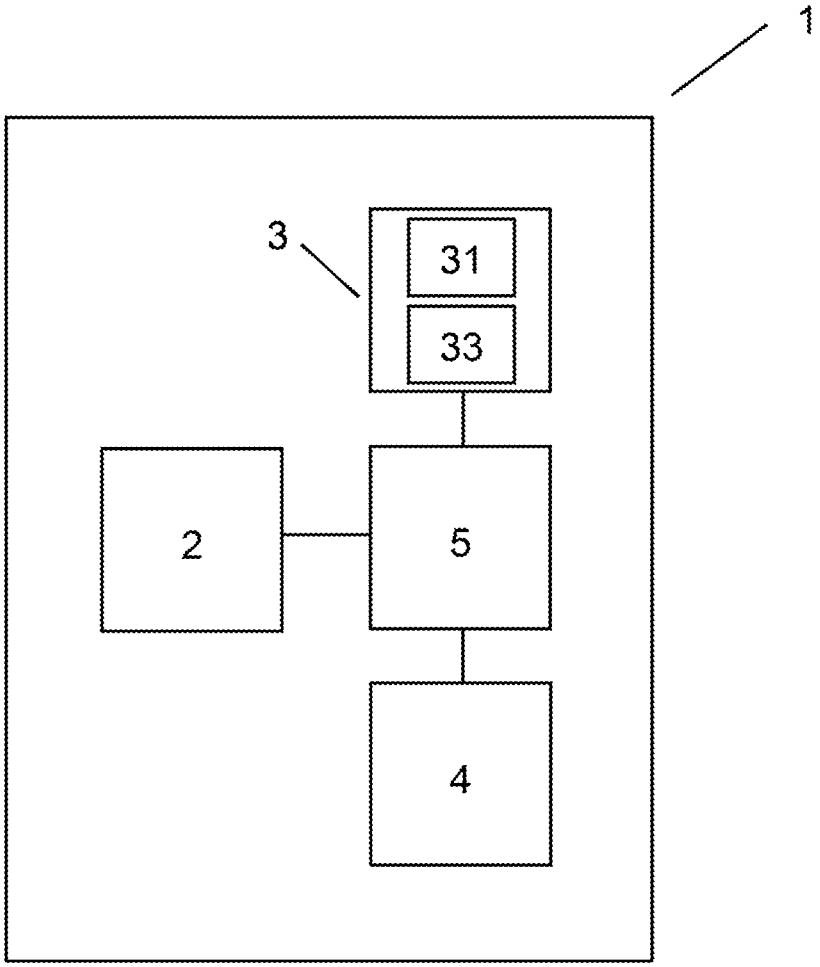
FIG. 3 is a schematic diagram illustrating the third embodiment of the present invention.

FIG. 3 illustrates a third embodiment of the improved LED status indicating unit 1 for an electrical appliance. The third embodiment is substantially the same as the first embodiment except for the following: In the third embodiment, the sensor 3 further comprises a temperature sensor 33 configured to detect one or more ambient temperatures as one or more temperature sensor inputs and produce one or more temperature sensor signals based on the one or more temperature sensor inputs. As an example, one of the predefined conditions of the storage unit 4 is that the temperature sensor signal is not between 16° C. and 20° C., and the command associated with the aforementioned condition is to control the flashing pattern of an LED status indicator to 3 short flashes followed by 3 long flashes at a predetermined brightness level.

Figure 4:
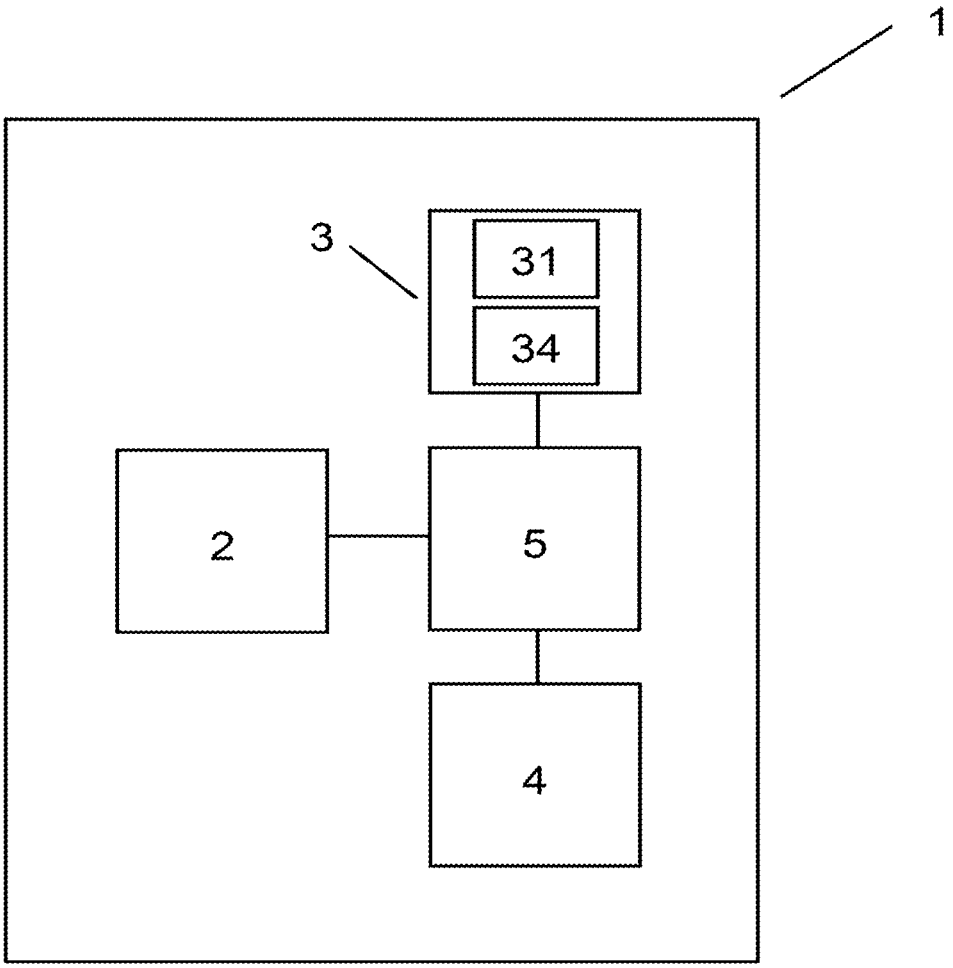
FIG. 4 is a schematic diagram illustrating the fourth embodiment of the present invention.

FIG. 4 illustrates a fourth embodiment of the improved LED status indicating unit 1 for an electrical appliance. The fourth embodiment is substantially the same as the first embodiment except for the following: In the fourth embodiment, the sensor 3 further comprises a video sensor 34 (or a motion sensor in other embodiments) configured to detect one or more object movements as one or more video sensor inputs and produce one or more video sensor signals based on the one or more video sensor inputs. As an example, one of the predefined conditions of the storage unit 4 is that the video sensor signal is indicative of full screen object movement for 5 seconds, and the command associated with the aforementioned condition is to control the glowing pattern of an LED status indicator to glow at a rate of one cycle per 5 seconds. This glowing pattern will tell caregivers that the baby monitor is still normally operational.

Figure 5:
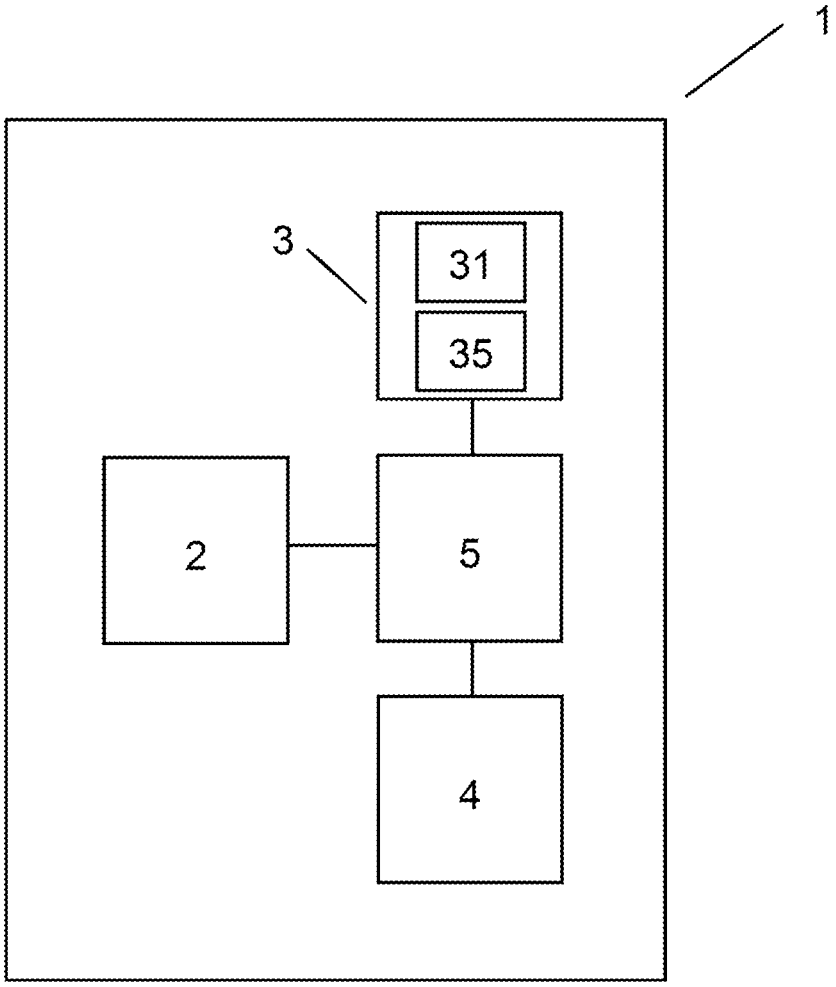
FIG. 5 is a schematic diagram illustrating the fifth embodiment of the present invention.

FIG. 5 illustrates a fifth embodiment of the improved LED status indicating unit 1 for an electrical appliance. The fifth embodiment is substantially the same as the first embodiment except for the following: In the fifth embodiment, the sensor 3 further comprises a microphone 35 configured to detect one or more sounds as one or more microphone inputs and produce one or more microphone signals based on the one or more microphone inputs. As an example, one of the predefined conditions of the storage unit 4 is that the microphone signal exceeds 90 dB (which may indicate a child's crying sound), and the command associated with the aforementioned condition is to control an LED status indicator to light up in blue color.

Figure 6:
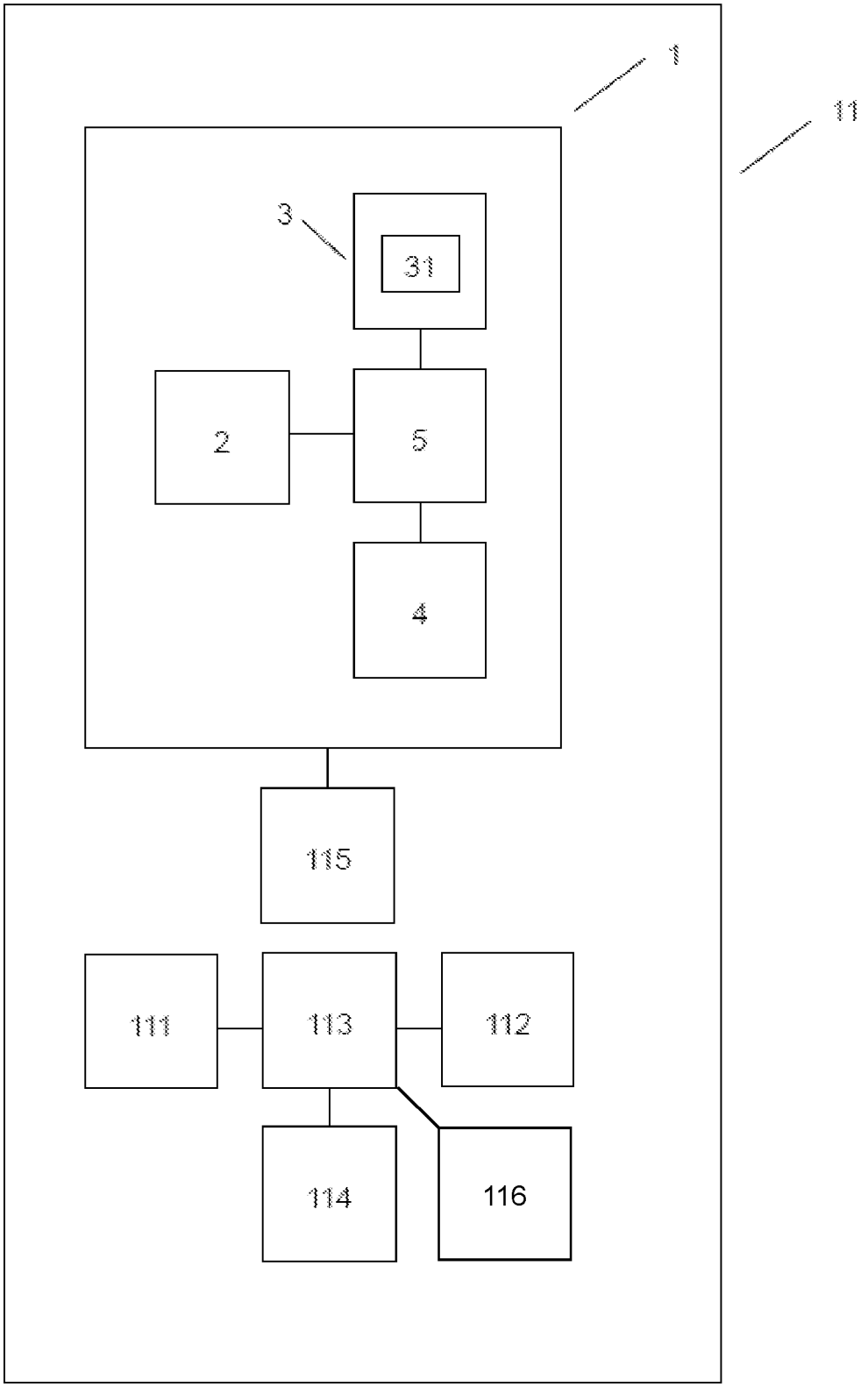
FIG. 6 is a schematic diagram illustrating the sixth embodiment of the present invention.

FIG. 6 illustrates a sixth embodiment of the present invention, which is a baby monitor 11 comprising the improved LED status indicating unit 1 in the present invention. In this embodiment, the baby monitor 11 comprises the improved LED status indicating unit 1 as in the first embodiment. In other embodiments, the baby monitor 11 may also comprise the improved LED status indicating unit 1 in any of the second to fifth embodiments. In this embodiment, the baby monitor 11 further comprises one 940 nm IR LED 111, one 850 nm IR LED 112, and a night mode IR LED selector 113 which is electrically connected to the 940 nm IR LED 111 and the 850 nm IR LED 112 and is configured to switch on the 940 nm IR LED 111 and switch off the 850 nm IR LED 112, or alternatively switch on both the 940 nm IR LED 111 and the 850 nm IR LED 112, based on predetermined condition. In this embodiment, the predetermined condition is upon receipt of a command input by a user interface element 114 (such as a touch screen) on the baby monitor 11. Also, the predetermined condition can be came from baby monitor processing unit 116 which implement the feature of the baby monitor related to the IR LEDs. The baby monitor 11 in this embodiment further comprises a nightlight 115 which is electrically connected to the improved LED status indicating unit 1. The processing unit 5 of the improved LED status indicating unit 1 is configured to control brightness level of the nightlight 115 based on the one or more signals produced by the sensor 3 of the improved LED status indicating unit 1.

Figure 7:
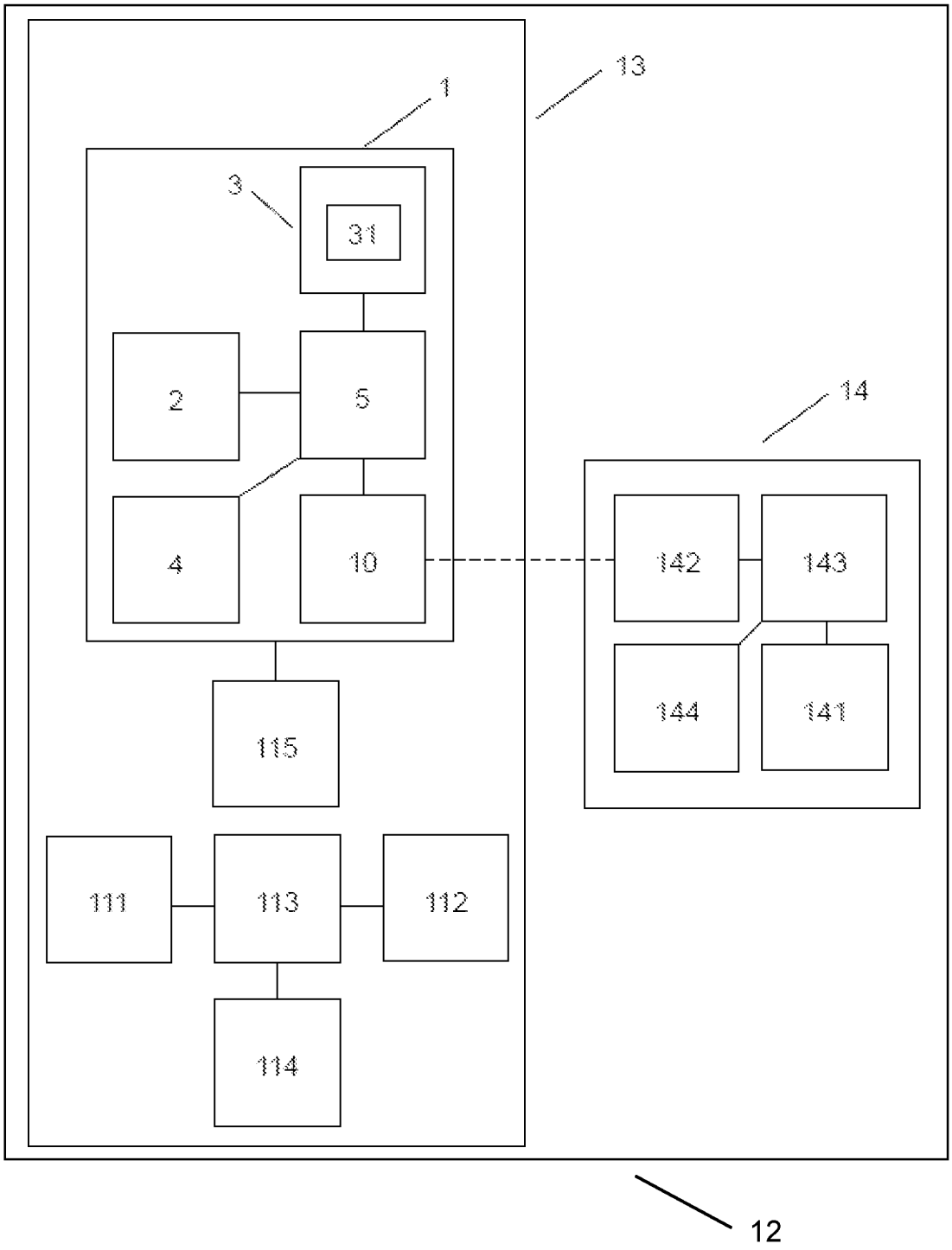
FIG. 7 is a schematic diagram illustrating the seventh embodiment of the present invention.

FIG. 7 illustrates a seventh embodiment of the present invention, which is a baby monitoring system 12 comprising a monitoring unit 13 and a parent unit 14. In this embodiment, the monitoring unit 13 is the baby monitor as in the sixth embodiment, and the improved LED status indicating unit 1 further comprises a control signal broadcast module 10 provided in operative communication with the processing unit 5 for broadcasting the command associated with the predefined condition satisfied. The parent unit 14 comprises a second unit LED status indicator 141, a control signal receiver 142 which is configured to receive the command broadcasted by the control signal broadcast module 10 of the monitoring unit 13, and a second unit control module 143 which is electrically connected between the second unit LED status indicator 141 and the control signal receiver 142. The second unit control module 143 is configured to control the brightness level of the second unit LED status indicator 141 according to the received command. As an example, if the sensor 3 of the monitoring unit 13 detects a low ambient light level (such as at night time) so that that light sensor signal satisfies the predefined condition that is associated with the command to lower the brightness level of an LED status indicator, the processing unit 5 of the monitoring unit 13 then lowers the brightness level of the LED status indicator 2 which is electrically connected with the processing unit 5 to the predetermined level which is very low as not to cause light disturbance to users nearby, and the control signal broadcast module 10 of the monitoring unit 13 broadcasts the command associated with the predefined condition satisfied (i.e. the command to lower the brightness level of an LED status indicator). The control signal receiver 142 of the parent unit 14 receives the command broadcasted by the control signal broadcast module 10 of the monitoring unit 13, and the second unit control module 143 controls the second unit LED status indicator 141 according to the received command, i.e. to lower the brightness level of the second unit LED status indicator 141. In this embodiment, the parent unit 14 further comprises a second unit nightlight 144 which is electrically connected to the second unit control module 143; the processing unit 5 of the improved LED status indicating unit 1 of the monitoring unit 13 is further configured to send a control signal to the control signal receiver 142 of the second unit 14 and the second unit control module 143 is configured to control brightness level of the second unit nightlight 144 based on the one or more light sensor signals produced by the sensor 3 of the improved LED status indicating unit 1 of the monitoring unit 13.

In other embodiments, the monitoring unit 13 may also comprise the improved LED status indicating unit 1 in any of the second to fifth embodiments. It is also possible for the baby monitoring system in another embodiment to comprise a monitoring unit having the same configuration as the parent unit in this embodiment.

Some of the preferred embodiments of the present invention are described above. It should be noted that improvements and modifications without deviating from the principle of the present invention may be possibly achieved by a person skilled in this field of art, and should fall within the scope of protection of the present invention.

What is claimed is:

1. A baby monitor, comprising a LED status indicating unit; wherein the LED status indicating unit comprises:

at least one LED status indicator configured to indicate an operating status of the electrical appliance;

at least one sensor each configured to produce one or more signals based on one or more sensor inputs;

a storage unit configured to store one or more predefined conditions, each of which being associated with a command for controlling one or more lighting parameters of at least one LED status indicator; and a processing unit electrically connected with the at least one LED status indicator configured to indicate an operating status of the electrical appliance, and provided in operative communication with the at least one sensor and the storage unit, and configured to:

determine, for each of the one or more signals produced by each of the at least one sensor, whether the signal satisfies any of the one or more predefined conditions; and if the signal satisfies any of the one or more predefined conditions, control the one or more lighting parameters of the at least one LED status indicator which is electrically connected with the processing unit according to the command associated with the predefined condition satisfied.

2. The baby monitor as in claim 1, wherein it further comprises at least one 940 nm IR LED, at least one 850 nm IR LED, and a night mode IR LED selector which is electrically connected to the at least one 940 nm IR LED and the at least one 850 nm IR LED and is configured to switch on the at least one 940 nm IR LED and switch off the at least one 850 nm IR LED, or alternatively switch on both the at least one 940 nm IR LED and the at least one 850 nm IR LED, based on predetermined condition.

3. The baby monitor as in claim 2, wherein the predetermined condition is upon receipt of a command input by a user interface element on the baby monitor.

4. The baby monitor as in claim 2, wherein the predetermined condition is came from feature implementation on the baby monitor.

5. The baby monitor as in claim 1, wherein it further comprises a nightlight which is electrically connected to the improved LED status indicating unit; the at least one sensor of the improved LED status indicating unit is a light sensor configured to detect one or more ambient light level as one or more light sensor input and produce one or more light sensor signals based on the one or more light sensor input, and the processing unit of the improved LED status indicating unit is configured to control brightness level of the nightlight based on the one or more light sensor signals produced by the light sensor of the improved LED status indicating unit.

6. A baby monitoring system comprising a first unit being one of a monitoring unit or a parent unit, and a second unit being another one of the monitoring unit or the parent unit, wherein the first unit comprises the improved LED status indicating unit as in claim 1, and the improved LED status indicating unit comprises a control signal broadcast module provided in operative communication with the processing unit for broadcasting the command associated with the predefined condition satisfied;

the second unit comprises at least one second unit LED status indicator, a control signal receiver which is configured to receive the command broadcasted by the control signal broadcast module of the first unit, and a second unit control module which is electrically connected between the at least one second unit LED status indicator and the control signal receiver and is configured to control one or more lighting parameters of the at least one second unit LED status indicator according to the received command.

7. The baby monitoring system as in claim 6, wherein the at least one sensor of the improved LED status indicating unit comprises one or more of the following: a light sensor for detecting ambient light level, an antenna for wirelessly receiving one or more control signals input by a user in a mobile application or other devices, a temperature sensor for sensing ambient temperature, a video sensor or motion sensor for sensing object movement, a microphone for sensing sound.

8. The baby monitoring system as in claim 6, wherein the one or more lighting parameters of the improved LED status indicating unit comprises one or more of the following: brightness level, color, flashing pattern, duration, glowing pattern.

9. The baby monitoring system as in claim 6, wherein the first unit further comprises a nightlight which is electrically connected to the improved LED status indicating unit; the at least one sensor of the improved LED status indicating unit is a light sensor configured to detect one or more ambient light level as one or more light sensor input and produce one or more light sensor signals based on the one or more light sensor input, and the processing unit of the improved LED status indicating unit is configured to control brightness level of the nightlight based on the one or more light sensor signals produced by the light sensor of the improved LED status indicating unit; the second unit further comprises a second unit nightlight which is electrically connected to the second unit control module; the processing unit of the improved LED status indicating unit of the first unit is further configured to send a control signal to the control signal receiver of the second unit and the second unit control module is configured to control brightness level of the second unit nightlight based on the one or more light sensor signals produced by the light sensor of the improved LED status indicating unit of the first unit.

* * * * *